US006663147B1

(12) United States Patent
Alban

(10) Patent No.: US 6,663,147 B1
(45) Date of Patent: Dec. 16, 2003

(54) LOCK

(75) Inventor: Antonio Alban, Bassano Del Grappa (IT)

(73) Assignee: Alban Giacomo S.p.A., Romano D'Ezzelino (IT)

( * ) Notice: Subject to any disclaimer, the term of this patent is extended or adjusted under 35 U.S.C. 154(b) by 71 days.

(21) Appl. No.: 09/656,865

(22) Filed: Sep. 7, 2000

(30) Foreign Application Priority Data

Sep. 30, 1999 (IT) ..... PD99A0213

(51) Int. Cl.[7] ..... E05C 9/00

(52) U.S. Cl. ..... 292/27; 292/65; 292/8; 292/27

(58) Field of Search ..... 292/5, 6, 7, 8, 292/27, 63, 65

(56) References Cited

U.S. PATENT DOCUMENTS

| | | | | | |
|---|---|---|---|---|---|
| 512,139 | A | * | 1/1894 | Willard | 292/46 |
| 840,297 | A | * | 1/1907 | Campbell | 292/27 |
| 1,083,173 | A | * | 12/1913 | Zeckhauser | 292/139 |
| 2,668,073 | A | * | 2/1954 | Collar et al. | 292/150 |
| 3,360,290 | A | * | 12/1967 | De Gray | 292/6 |
| 4,239,268 | A | * | 12/1980 | Rider | 292/5 |
| 4,534,191 | A | * | 8/1985 | Rogers et al. | 70/116 |
| 4,615,550 | A | * | 10/1986 | Abate | 292/192 |

FOREIGN PATENT DOCUMENTS

| | | | | |
|---|---|---|---|---|
| DE | 14 28 512 | | 5/1969 | |
| DE | 93 21 445 | | 2/1998 | |
| EP | 0 096 512 | | 12/1983 | |
| EP | 0 677 634 | | 10/1995 | |
| EP | 0 785 321 | | 7/1997 | |
| EP | 0 945 572 | | 9/1999 | |
| FR | 2666370 | A1 * | 3/1992 | E05B/15/02 |
| GB | 2275500 | * | 8/1994 | 292/5 |

* cited by examiner

*Primary Examiner*—William L. Miller
*Assistant Examiner*—Dinesh Melwani
(74) *Attorney, Agent, or Firm*—Guido Modiano; Albert Josif; Daniel J. O'Byrne

(57) ABSTRACT

A lock comprising, within a box-like supporting body and associated with actuation elements which are available to the action of the user and/or of other devices, three locking beaks: two first lateral ones, whose free tips are shaped so as to form mutually opposite claws which lie on the plane of the closure and opening movement, and a third central beak, which is kinematically connected and coordinated with respect to the two first beaks and is provided, at its free tip, with at least one locking element. The three beaks define, in association with the actuation elements, at least two stable working positions: a first open position, in which the beaks lie substantially completely within the box-like supporting body, and a second closed position, in which the beaks protrude from the box-like supporting body with their free tips so as to lock the components with which they are associated.

22 Claims, 2 Drawing Sheets

LOCK

BACKGROUND OF THE INVENTION

The present invention relates to a lock.

It is known that a lock for application to doors or main doors but also for connecting any two elements to be mutually reversibly fixed, must ensure complete and secure locking and allow the user, or connected actuation devices, to easily pass from a stable closed condition to an equally stable open condition and vice versa.

Locks are already known which comprise, inside a box-like supporting body and associated with actuation means available to the action of the user and/or of other devices, two lateral locking beaks whose free tips are shaped so as to define mutually opposite claws which lie on the plane of the closure and opening movement.

SUMMARY OF THE INVENTION

The aim of the present invention is to provide a lock whose structure allows more secure locking of the elements to which it is applied with respect to conventional locks with two claw-shaped beaks, at the same time ensuring nonetheless easy and rapid transition from the closed condition to the open condition and vice versa.

Within the scope of this aim, an important object of the present invention is to provide a lock whose structure is in any case sturdy and inalterable even if subjected to considerable stresses and prolonged use.

Another object of the present invention is to provide a lock whose structure allows easy and precise movement.

Another object of the present invention is to provide a lock whose structure can also be mass-manufactured by partially or fully automated assembly procedures.

Another object of the present invention is to provide a lock with a structure which can be manufactured with conventional technologies and systems.

These and other objects which will become better apparent hereinafter are achieved by a lock comprising, within a box-like supporting body and associated with actuation means which are available to the action of the user and/or of other devices, two first lateral locking beaks whose free tips are shaped so as to define mutually opposite claws which lie, on the plane of the closure and opening movement, said lock being characterized in that it comprises a third central beak which is kinematically connected and coordinated with respect to the two first beaks and is provided, at its free tip, with at least one locking element, said three beaks defining, in association with said actuation means, at least two stable working positions: a first open position, in which said beaks lie substantially completely within said box-like support, and a second closed position, in which they protrude from said box-like support with their free tips so as to lock the components with which they are associated.

BRIEF DESCRIPTION OF THE DRAWINGS

Further characteristics and advantages of the present invention will become better apparent from the following detailed description of an embodiment thereof, illustrated only by way of non-limitative example in the accompanying drawings, wherein.

DESCRIPTION OF THE PREFERRED EMBODIMENTS

Figure 2:
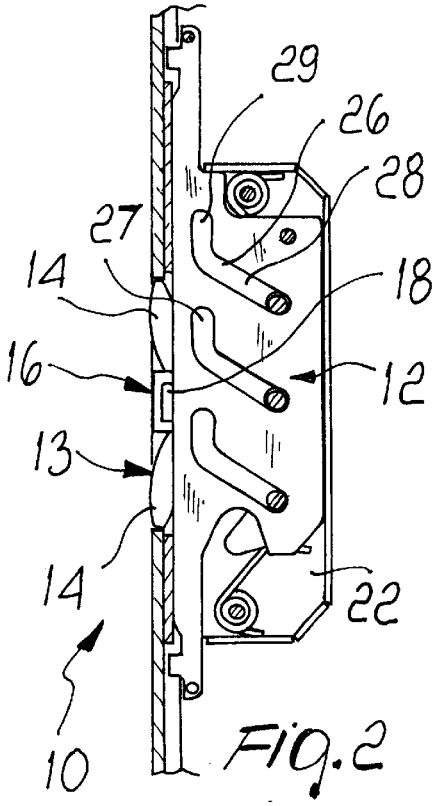
FIG. 2 is a partially sectional orthographic projection view of the lock of FIG. 1.
Figure 1:
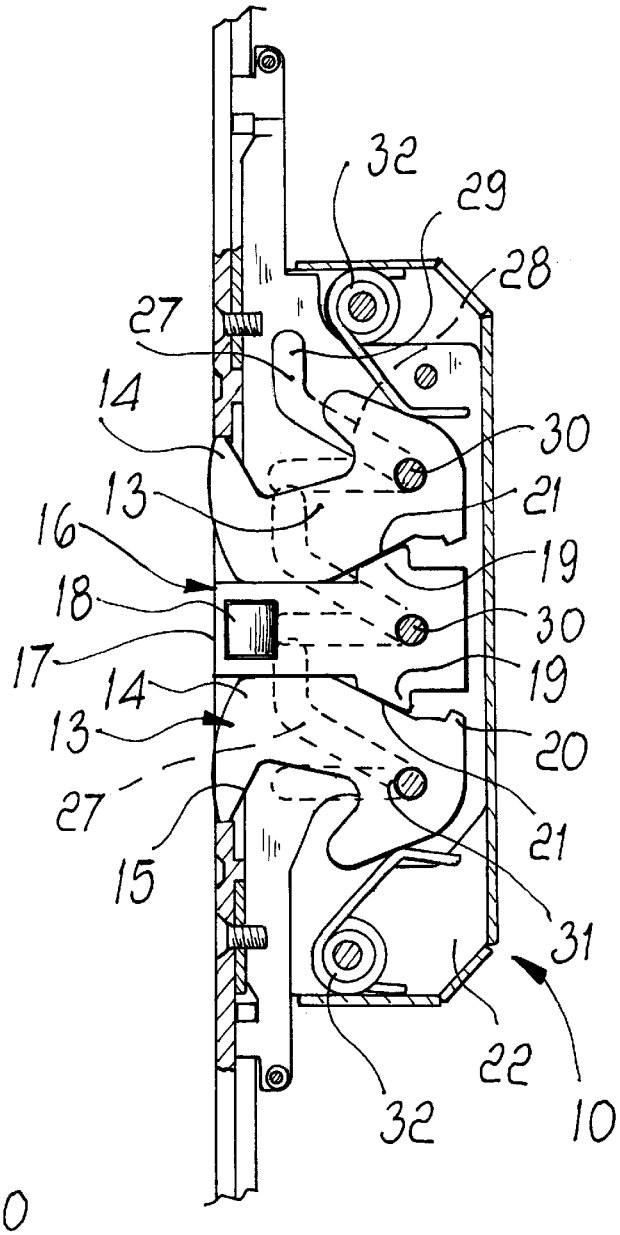
FIG. 1 is a sectional orthographic projection view of a lock having the structure according to the invention.
Figure 3:
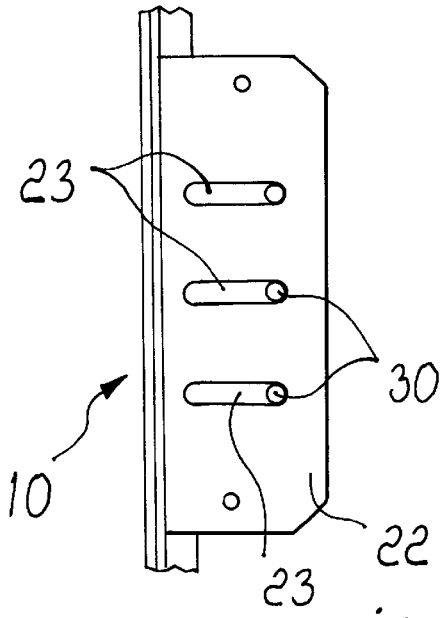
FIG. 3 is another orthographic projection view of the lock of FIG. 1.
Figures 4, 5:
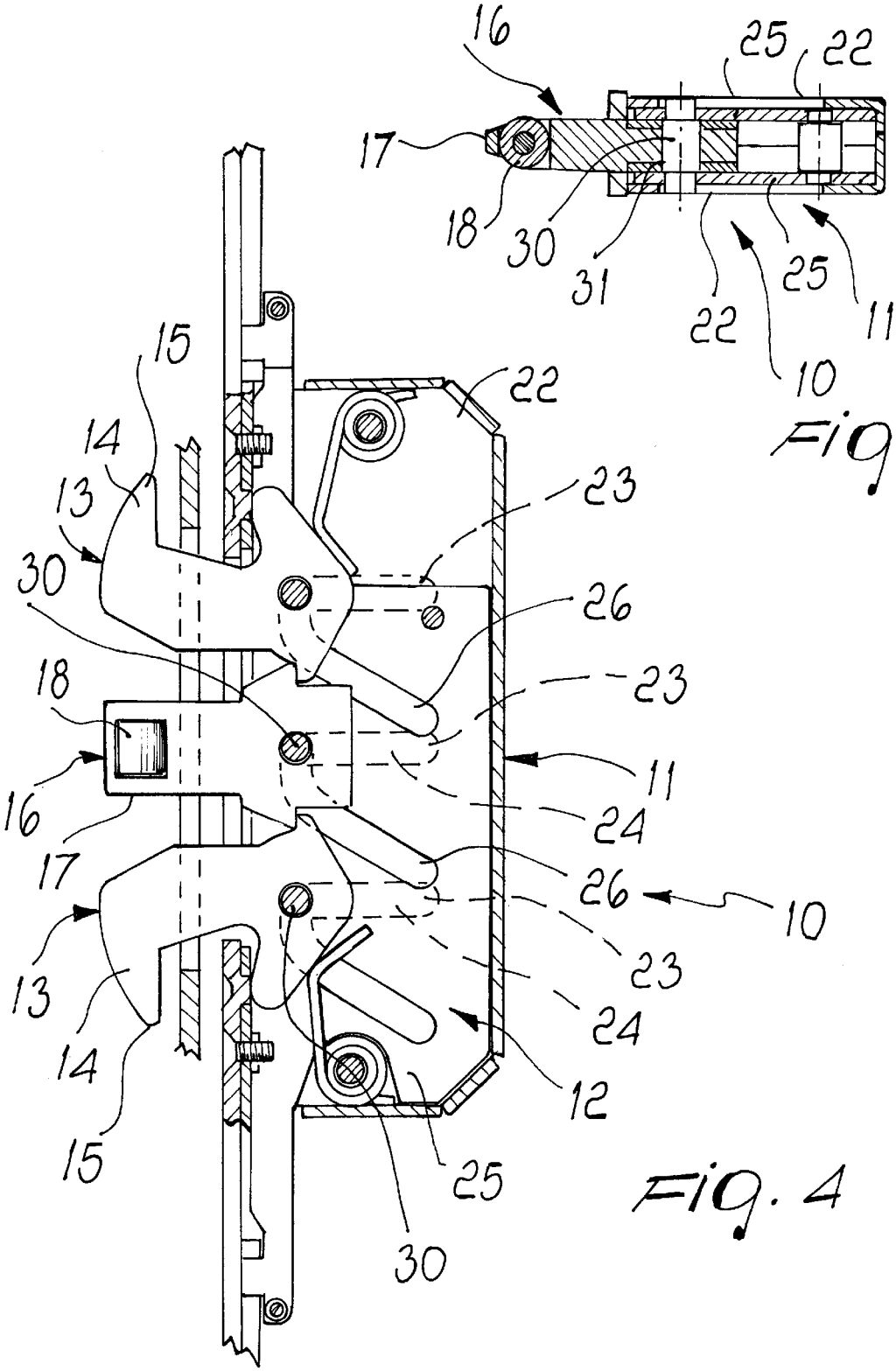
FIG. 4 is a sectional orthographic projection view of the lock of FIG. 1 during opening.
FIG. 5 is a sectional view of the lock of FIG. 1.

With reference to FIGS. 1 to 5, a lock having the structure according to the invention is generally designated by the reference numeral 10.

The lock 10 comprises, within a box-like supporting body 11 and associated with actuation means 12 available to the action of the user and/or of other devices described in greater detail hereinafter, three locking beaks: two first lateral ones 13 have free tips 14 which are shaped so as to define mutually opposite claws 15 which lie on the plane of the closing and opening movement, and a third central beak 16 is kinematically connected to, and coordinated with, the two first beaks 13 and is provided, at its free tip 17, with a locking element which is constituted by a cylinder 18 which is pivoted with an axis which lies on the same plane of arrangement as the claws 15.

The three beaks 13 and 16 form, in association with said actuation means 12, at least two stable working positions: a first open position, in which the beaks lie substantially completely within the box-like support 11, and a second closed position, in which the beaks protrude from the box-like support 11 with their free tips so as to lock the components with which they are associated.

In particular, the third beak 16 is plate-shaped and contoured so as to form two first mutually opposite tabs 19 which form two stroke limit abutment surfaces for the two first beaks 13 both during opening and during closure.

The two first beaks 13 also are plate-shaped and contoured so as to form two second tabs 20 which are suitable to abut, at the end of their stroke, against respective first tabs 19 during closure.

The two first beaks 13 have edge portions, designated by the reference numeral 21, which are shaped so that they, too, abut at the end of their stroke against the first tabs 19 during opening.

In this embodiment, the actuation means comprise two pairs of plates in mutually opposite positions; each pair comprises a first plate 22, which is fixed to the supporting body 11 and is provided with three first linear guides 23 constituted by the walls of a corresponding number of slotted holes 24, and a second plate 25, which can move parallel to the first plate 22 and also is provided with three second guides 26, which are constituted by the edges of a corresponding number of slotted holes 27, are substantially L-shaped and correspond to said first guides 23.

Each one of the second guides 26 is formed by a portion 28 which is inclined with respect to the corresponding first guide 23 and a portion 29 which is perpendicular to said first guide 23.

The actuation means 12 also comprise three pivots 30 which are slidingly inserted in the first guides 23 and in the second guides 26 and are pivoted in corresponding through holes 31 formed in the corresponding first 13 and third 16 beaks so as to determine the movement of said first beaks when the second plate 25 slides.

Moreover, the actuation means 12 also comprise elastic contrast pusher elements for each one of the first beaks 13; said elements, in this case, are constituted by helical springs 32 which are rigidly pivoted to the supporting body 11.

In practice, operation is as follows: the sliding of the second plates 25, actuated by the user and/or by other devices arranged upstream, determines, as a consequence of the interference of the first guides 23 with the second guides 26, the movement of the three pivots 29 in a direction which is perpendicular to the direction of the movement of said second plate 25.

This movement of the pivots induces a consequent opening or closure movement of the first beaks 13 and of the third beak 16, depending on the direction of movement of the second plate 25.

In practice it has been observed that the present invention has achieved the intended aim and objects.

In particular, it should be noted that the lock having the structure according to the invention is particularly secure during locking and provides substantially complete and interference-free disengagement during opening.

Attention is also drawn to the overall structural solidity of the lock according to the invention, which can therefore be easily used even in situations entailing particularly heavy-duty and frequent use.

It should also be noted that the lock having the structure according to the invention easily allows transition from the two stable working conditions in one direction and the other, without causing any kind of problem in terms of possible jamming or difficulties.

The present invention is susceptible of numerous modifications and variations, all of which are within the scope of the appended claims.

The technical details can be replaced with other technically equivalent elements.

The materials may be any according to requirements.

The disclosures in Italian Patent Application No. PD99A000213 from which this application claims priority are incorporated herein by reference.

What is claimed is:

1. A lock, comprising, within a box-like supporting body and associated with actuation means which are available to the action of any of a user and of other devices, two first lateral locking beaks having free tips shaped so as to form mutually opposite claws lying on a plane of a closure and opening movement, said lock further comprising:

a third central beak, which is kinematically connected and coordinated with respect to the two first beaks;

at least one locking element, provided at a free tip of said third beak, said three beaks defining, in association with said actuation means, at least two stable working positions: a first open position, in which said two first beaks and said third beak lie completely within said box-like supporting body, and a second closed position, in which said two first beaks and sad third beak protrude from said box-like supporting body with said free tips thereof so as to lock components with which the beaks are associated, said third beak acting as a bolt; and two first mutually opposite tabs formed on the contour of said third beak, said first tabs providing a corresponding number of stoke limit abutment surfaces for said two first beaks both during closure and during opening.

2. The lock of claim 1, wherein said third beak comprises, at a free end thereof, at least one locking element, said locking element being constituted by a cylinder pivoted about an axis lying on a same plane of arrangement as said claws.

3. The lock of claim 1, wherein said third beak is plate-shaped.

4. The lock of claim 3, wherein said two first beaks are plate-shaped and contoured so as to form two second tabs, said second tabs being adapted to abut, at a stroke end thereof, against said first tabs during closure.

5. The lock of claim 4, wherein said two first beaks have edge portions which are shaped so as to abut, at the stroke end thereof, against said first tabs during opening.

6. The lock of claim 1, wherein said actuation means comprise: two pairs of plates, each pair being constituted by a first plate, which is fixed to said supporting body and is provided with three first linear guides, said first linear guides being constituted by walls of a corresponding number of slotted holes provided at said first plate, and by a second plate, which is movable parallel to said first plate, said second plate being provided with three second guides, said second guides being constituted by walls of a corresponding number of slotted holes, provided at said second plate, which are L-shaped and correspond to said first guides, each one of said second guides being formed by a portion which is inclined with respect to the corresponding first guide, and by a portion which is perpendicular to said corresponding first guide; and three pivots which are slidingly inserted in said first and second guides, said pivots being pivoted at through holes of said corresponding beaks, so as to determine movement of the beaks when said second plate slides.

7. The lock of claim 6, wherein said actuation means further comprise elastic contrast pusher elements for each one of said two first beaks.

8. The lock of claim 7, wherein said elastic contrast pusher means are constituted by helical springs, which are pivoted in mutually opposite pivoting points, which are provided fixed at the box-like supporting body.

9. A lock, comprising, within a box-like supporting body and associated with actuation means which are available to the action of any of a user and of other devices, two first lateral locking beaks having free tips shaped so as to form mutually opposite claws lying on a plane of a closure and opening movement, said lock further comprising:

a third central beak, which is kinematically connected and coordinated with respect to the two first beaks;

at least one locking element, provided at a free tip of said third beak, said locking element being constituted by a cylinder pivoted about an axis lying on a same plane of arrangement as said claws, and said three beaks defining, in association with said actuation means, at least two stable working positions: a first open position, in which said beaks lie substantially completely within said box-like supporting body, and a second closed position, in which said beaks protrude from said box-like supporting body with said free tips thereof so as to lock components with which the beaks are associated.

10. The lock of claim 9, wherein said third beak is plate-shaped and contoured so as to form two first mutually opposite tabs, said first tabs providing a corresponding number of stroke limit abutment surfaces for said two first beaks, both during closure and during opening.

11. The lock of claim 10, wherein said two first beaks are plate-shaped and contoured so as to form two second tabs, said second tabs being adapted to abut, at a stroke end thereof, against said first tabs during closure.

12. The lock of claim 11, wherein said two first beaks have edge portions which are shaped so as to abut, at the stroke end thereof, against said first tabs during opening.

13. The lock of claim 9, wherein said actuation means comprise: two pairs of plates, each pair being constituted by a first plate, which is fixed to said supporting body and is provided with three first linear guides, said first linear guides being constituted by walls of a corresponding number of slotted holes provided at said first plate, and by a second plate, which is movable parallel to said first plate, said second plate being provided with three second guides, said second guides being constituted by walls of a corresponding number of slotted holes, provided at said second plate, which are L-shaped and correspond to said first guides, each one of said second guides being formed by a portion which is inclined with respect to the corresponding first guide, and by a portion which is perpendicular to said corresponding first guide; and three pivots which are slidingly inserted in said first and second guides, said pivots being pivoted at through holes of said corresponding beaks, so as to determine movement of the beaks when said second plate slides.

14. The lock of claim 13, wherein said actuation means further comprise elastic contrast pusher elements for each one of said two first beaks.

15. The lock of claim 14, wherein said elastic contrast pusher means are constituted by helical springs, which are pivoted in mutually opposite pivoting points, which are provided fixed at the box-like supporting body.

16. A lock, comprising, within a box-like supporting body and associated with actuation means which are available to the action of any of a user and of other devices, two first lateral locking beaks having free tips shaped so as to form mutually opposite claws lying on a plane of a closure and opening movement, said lock further comprising: a third central beak, which is kinematically connected and coordinated with respect to the two first beaks; at least one locking element, provided at a free tip of said third beak, said three beaks defining, in association with said actuation means, at least two stable working positions: a first open position, in which said beaks lie substantially completely within said box-like supporting body, and a second closed position, in which said beaks protrude from said box-like supporting body with said free tips thereof so as to lock components with which the beaks are associated; and said actuation means comprising two pairs of plates, each pair being constituted by a first plate, which is fixed to said supporting body and is provided with three first linear guides, said first linear guides being constituted by walls of a corresponding number of slotted holes provided at said first plate, and by a second plate, which is movable parallel to said first plate, said second plate being provided with three second guides, said second guides being constituted by walls of a corresponding number of slotted holes, provided at said second plate, which are L-shaped and correspond to said first guides, each one of said second guides being formed by a portion which is inclined with respect to the corresponding first guide, and by a portion which is perpendicular to said corresponding first guide; and three pivots which are slidingly inserted in said first and second guides, said pivots being pivoted at through holes of said corresponding beaks, so as to determine movement of the beaks when said second plate slides.

17. The lock of claim 16, wherein said actuation means further comprise elastic contrast pusher elements for each one of said two first beaks.

18. The lock of claim 17, wherein said elastic contrast pusher means are constituted by helical springs, which are pivoted in mutually opposite pivoting points, which are provided fixed at the box-like supporting body.

19. The lock of claim 16, wherein said third beak comprises, at a free end thereof, at least one locking element, said locking element being constituted by a cylinder pivoted about an axis lying on a same plane of arrangement as said claws.

20. The lock of claim 16, wherein said third beak is plate-shaped and contoured so as to form two first mutually opposite tabs, said first tabs providing a corresponding number of stroke limit abutment surfaces for said two first beaks, both during closure and during opening.

21. The lock of claim 20, wherein said two first beaks are plate-shaped and contoured so as to form two second tabs, said second tabs being adapted to abut, at a stroke end thereof, against said first tabs during closure.

22. The lock of claim 21, wherein said two first beaks have edge portions which are shaped so as to abut, at the stroke end thereof, against said first tabs during opening.

* * * * *